US005132586A

United States Patent [19]

Boulais et al.

[11] Patent Number: 5,132,586

[45] Date of Patent: Jul. 21, 1992

[54] MICROCHANNEL ELECTRON SOURCE

[75] Inventors: Kevin Boulais, Silver Spring; Joon Choe, Potomac, both of Md.

[73] Assignee: The United States of America as represented by the Secretary of the Navy, Washington, D.C.

[21] Appl. No.: 680,864

[22] Filed: Apr. 4, 1991

[51] Int. Cl.[5] ..... H01J 43/04; H01J 43/00

[52] U.S. Cl. ..... 313/105 CM; 313/103 CM

[58] Field of Search ..... 313/103 CM, 105 CM; 250/213 VT, 207, 330

[56] References Cited

U.S. PATENT DOCUMENTS

| | | | |
|---|---|---|---|
| 3,854,066 | 12/1974 | Payne | 313/105 CM |
| 3,879,626 | 4/1975 | Washington et al. | 313/105 CM |
| 3,964,411 | 8/1976 | Faulkner et al. | 313/105 CM |
| 3,979,621 | 9/1976 | Yates | 313/105 CM |
| 4,147,932 | 4/1979 | Lewis | 250/330 |
| 4,313,072 | 1/1982 | Wilson et al. | 315/5 |
| 4,701,618 | 10/1987 | Tosswill | 250/330 |

*Primary Examiner*—Donald J. Yusko
*Assistant Examiner*—Nimesh Patel
*Attorney, Agent, or Firm*—Kenneth E. Walden; Jacob Shuster

[57] ABSTRACT

A microchannel plate device utilizing a semiconducting bulk material is characterized by electron emissions of high output current density and efficiency. The channel passages in the plate device which are square in cross-section accommodates a larger open area ratio at the input and output plate surfaces. An extended range of high electron emission applications for the plate device is provided. Such applications may include a photocathode installation to which a modulation pulse input is applied under low voltages isolated from high post-accelerating voltages.

5 Claims, 4 Drawing Sheets

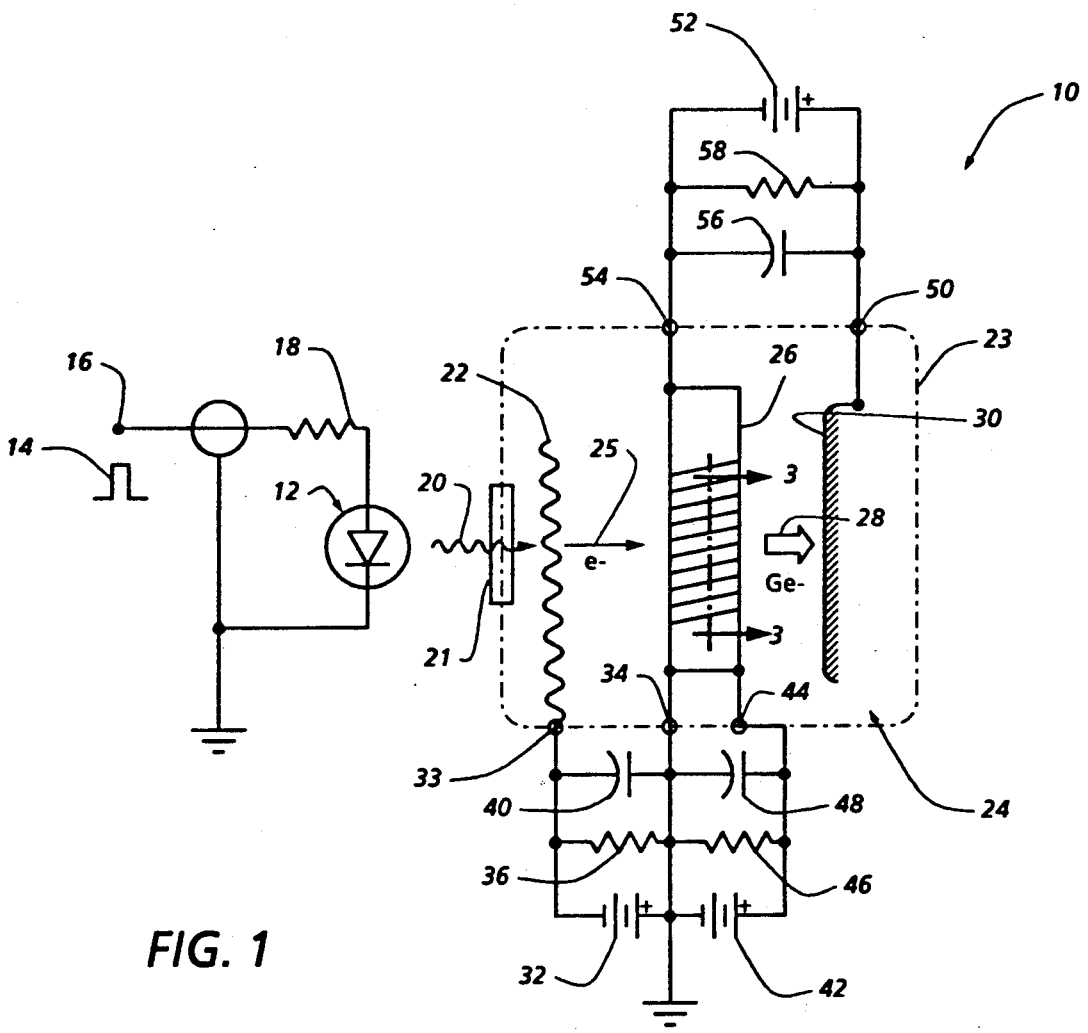
FIG. 1
FIG. 5
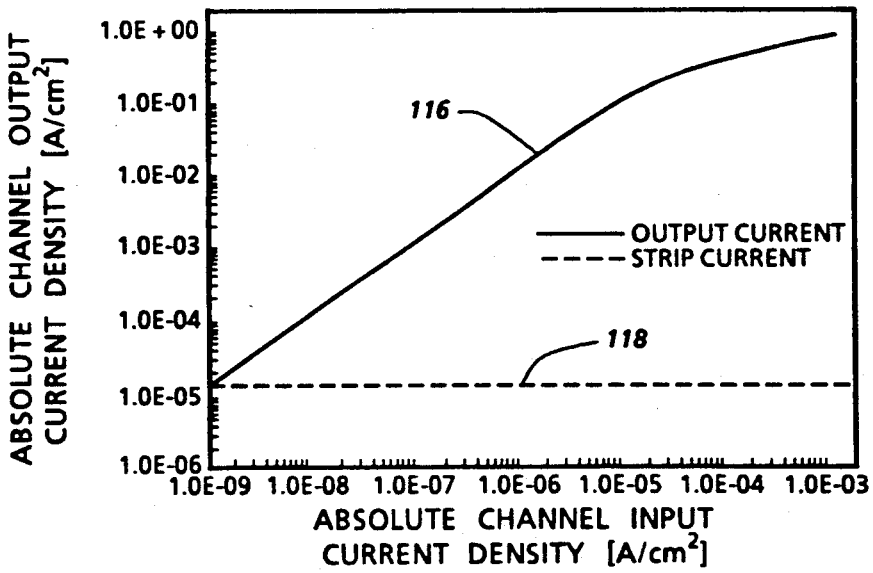

MICROCHANNEL ELECTRON SOURCE

BACKGROUND OF THE INVENTION

This invention relates generally to the emission of electrons and more particularly to an improved microchannel plate type of electron amplifier.

Various electronic devices involve the generation of electrons within a vacuum chamber, such electrons being liberated as emissions from a solid surface of an electrode. An electron emission system wherein the pulse modulating characteristics of impinging light entering a vacuum chamber from a laser source to supply the requisite emission triggering energy, is disclosed for example in U.S. Pat. No. 4,313,072 to Wilson et al.

Electron emission devices including microchannel plates are also generally known in the art as disclosed for example in U.S. Pat. Nos. 4,147,932 and 4,701,618 to Lewis and Tosswill. Such microchannel plates consist of an array of small cylinder shaped, continuous dynode electron multipliers through which current amplification is achieved by secondary electron emissions. The secondary emission phenomenon involves the bombardment of solid electron emitting surfaces with electrons.

Standard microchannel plates acting as an electron amplifier are desirable because of certain associated characteristics such as high gain, low noise, etc. However, because of other accompanying characteristics electron current density is severely limited by plate overheating. Such microchannel plates furthermore require plate bias current at least 10 times the output current at gain saturation exhibiting at most 10% efficiency. Accordingly, operation of microchannel plate devices at higher current levels was not deemed to be desirable.

It is therefore an important object of the present invention to provide a modified form of microchannel plate acting as an electron amplifier which is capable of being pulse modulated at high repetition rates and short pulse widths and yet produce moderate current density without overheating while retaining other desirable characteristics of standard microchannel plates.

Further objects of the invention in accordance with the foregoing object is to provide a microchannel type of electron emission source that is more efficient, in both a linear and saturated mode, and capable of isolating pulse modulating signal inputs from high post-acceleration voltages in a wide range of applications.

SUMMARY OF THE INVENTION

In accordance with one embodiment of the present invention, a moderate current, high repetition and short pulse width cathode associated with a microchannel electron source provides an output at a substantial current level in response to a modulated input applied to the electron source. Such input is modulated via a diode injection laser and is transmitted to a photocathode while the output current from a microchannel plate type of electron source is accelerated toward a suitable anode. Such an arrangement allows high DC accelerating voltages while reducing modulation requirements to those of the laser. The microchannel plate source having parallel spaced channels in a semiconducting substrate, is modified to provide a conductance that is modulated in proportion to the output current allowing higher output current levels without overheating and with efficiencies approaching 100%. The channels, which are square in cross-section, are internally coated with material of reduced conductivity to establish an increased secondary emission coefficient dependent on overall gain and channel geometry. Further, the channels may be angled relative to a direction perpendicular to opposite face surfaces of the plate in order to reduce ion feedback.

BRIEF DESCRIPTION OF THE DRAWING FIGURES

The foregoing and other objects, novel features and advantages of the present invention will be more apparent from the following more particular description of the preferred embodiments as illustrated in the accompanying drawings, in which:

FIG. 1 is a circuit diagram schematically depicting the apparatus of the present invention in accordance with one embodiment;

FIGS. 5, 6 and 7 are graphs illustrating the characteristics of various operational parameters associated with the apparatus of FIGS. 1–4.

DETAILED DESCRIPTION OF PREFERRED EMBODIMENT

Figure 2:
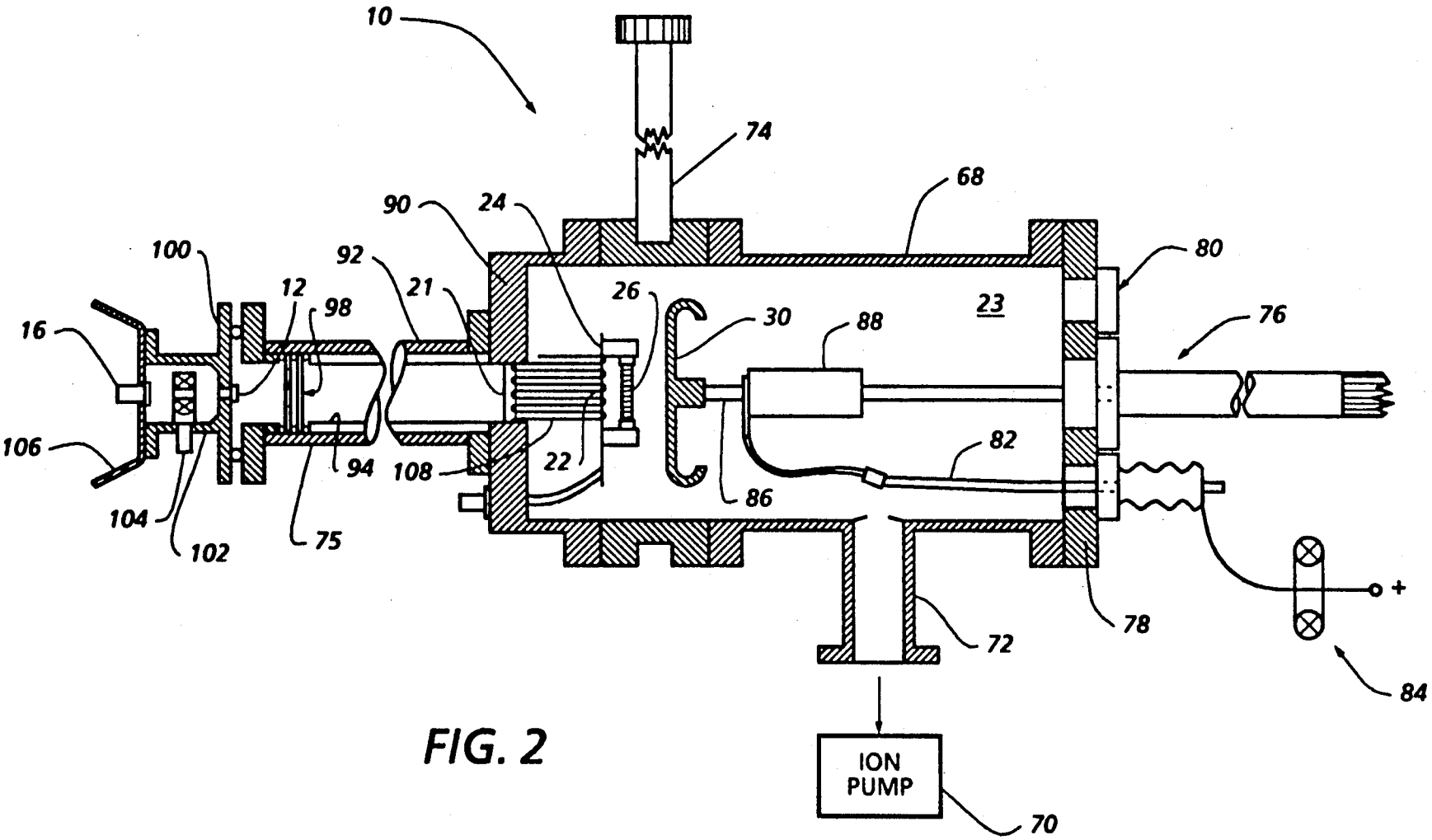
FIG. 2 is a side section view of a test version of the apparatus depicted in FIG. 1, illustrating its constructional arrangement.

Referring now to the drawing in detail, FIG. 1 schematically depicts apparatus, generally referred to by reference numeral 10,embodying the present invention. A light source associated with the apparatus 10 in the form of an injection laser diode 12 has a modulating voltage pulse 14, applied at input terminal 16, which is converted through resistor 18 to provide an input current. Pulse modulated light 20 emitted from laser diode 12 is accordingly transmitted through a window 21 of a vacuum chamber 23 to a photocathode 22 housed therein to form part of an electron transfer assembly portion 24 of the apparatus. In addition to the photocathode constituting a source of the electrons depicted at 25, the electron transfer portion 24 includes a microchannel electron source 26 through which electrons emitted from photocathode 22 are amplified, as indicated at 28, before collection at an anode 30.

Acceleration of the photoelectrons at 25 toward the microchannel electron source 26 is induced by a moderate voltage from a power source 32 applied to cathode terminal 33 as depicted in FIG. 1. A low current under a voltage in the order of 1 kV is accordingly conducted from the positive grounded terminal of power source 32. A discharge resistor 36 is connected across the terminals of power source 32 for safety purposes in the event of failure while a capacitor 40 in parallel therewith stabilizes the voltage. The photoelectrons at 25 should accordingly arrive at the input face surface of microchannel source 26 at an energy level in the order of 1 keV in order to excite first stage secondary emission within the microchannel source grounded at its input face through terminal 34 as depicted in FIG. 1.

A positive voltage potential from a power source 42 is applied to terminal 44 of the microchannel source 26 to establish an electric field therein. A discharge resistor 46 and capacitor 48 are connected in parallel across the terminals of the power source 42 and terminals 34 and 44 of the microchannel source 26 for safety purposes and to stabilize the electric field therein at a level in the order of 10 kV/cm for a microchannel plate thickness in the order of 1 mm with an associated bias current generally less than 1 mA.

The electrons quantatively amplified at 28 with a gain G, are accelerated toward anode 30 under a suitable accelerating voltage applied thereto at terminal 50 from the positive terminal of a DC power source 52 having a negative terminal grounded through the input face of the microchannel source 26 to which it is connected at terminal 54. The power source 52 has a current rating greater than that of the electrons at 28, under a voltage stabilized by capacitor 56 connected in parallel with safety discharge resistor 58 across the terminals of power source 52. The voltage level of power source 52 is selected to meet different installational requirements for the beam of electrons at 28, such as that of a microwave power supply wherein the electron beam at 28 is injected into a microwave tube.

A version of the apparatus 10 for testing purposes is shown in FIG. 2, wherein the electron transfer portion 24 is disposed within vacuum chamber 23 enclosed by a housing 68 connected to an ion pump 70 through its outlet fitting 72. A gate valve 74 is used so that the photocathode 22 previously constructed within a suitable environment may be transferred to test chamber 68 without exposure to air which adversely affects the stability of some photocathodes. The anode 30 is adjustably spaced from the microchannel source 26 by means of a support rod 86 connected to linear feed device 76 projecting into the housing chamber through end wall 78 having diagnostic ports 80 therein, including one through which an output current lead 82 extends to an external current monitor 84. The output current lead is electrically connected to the anode 30 at a location on its support rod 86 insulated from the housing and the device 76 by a standoff element 88.

The other end wall 90 of the housing 68 has an opening formed therein through which the optical system 75 projects into the chamber 23 from an external cylindrical sleeve 92 having an internal surface mirror 94 extending axially from the vacuum chamber window 21 in the end wall to neutral density filters 98 adjacent a sleeve end connected by means of a 3-point axial alignment device 100 to a support housing 102 enclosing a current monitor 104 for the input signal line from the laser pulse input terminal 16 protectively surrounded by a heat sink element 106. The pulse modulated signal light 20 emerging from the laser diode 12 is accordingly transmitted by the sleeve 92, passing in sequence through filters 98 and window 21, for conduction to the photocathode 22 by a fiber optic bundle 108.

Figure 3:
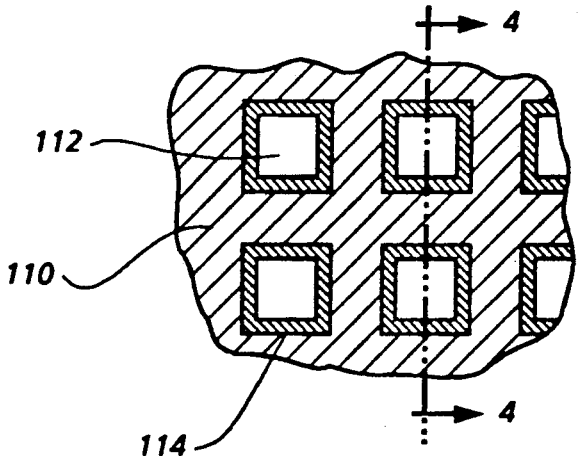
FIG. 3 is an enlarged partial section view of the microchannel plate taken substantially along section line 3—3 in FIG. 1.
Figure 4:
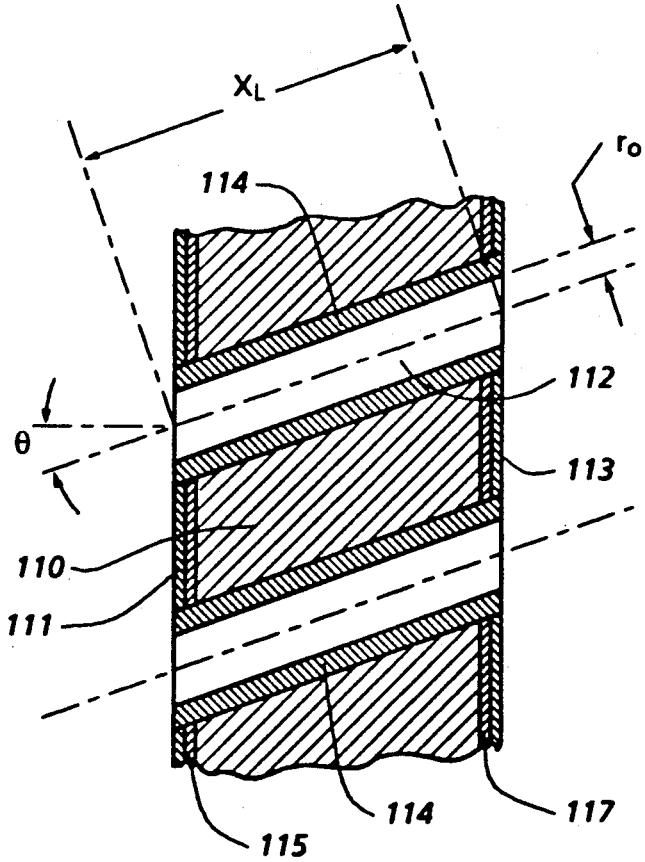
FIG. 4 is a partial section view taken substantially along section line 4—4 in FIG. 3.

An essential feature of the invention resides in the construction of the microchannel source 26 having a relatively thin substrate wafer plate 110 made of a semiconductor bulk material, as shown in FIGS. 3 and 4. A plurality of parallel spaced channel passages of square cross-section are formed in the plate 110 as shown, allowing a large ratio of open area to overall plate area. Further, the geometry of the channel passages having a half width dimension ($r_o$) and a channel axial distance ($X_1$) as denoted in FIG. 4, is such that equal transverse path lengths ($2r_o$) are maintained for electrons regardless of their originating position from the wall. The channel paths also extend at an angle ($\theta$) to the direction normal to the faces of the plate 110 in order to reduce ion feedback.

The walls of the channel are coated with a material 114 of less conductivity than the bulk to increase the secondary emission coefficient appropriate to the desired gain. The thickness of the coating is thin enough to allow secondary emission electrons to originate from within the semiconductor material leaving positively charged holes for conduction within the valence band of the semiconductor. According to one embodiment, ohmic contacts are established on the plate faces by metallization layers 111 and 113 and dopant layers 115 and 117 having impurities appropriate to the semiconductor substrate material of plate 110. The junctions so formed by metalization layer 111 with or without dopant layer 115 allow passage of the positively charged holes for recombination within the metalization layer 111. Similarly, the junctions formed by metalization layer 113 and impurity dopant layer 117 allow the thermally generated electrons in the conduction band of the semiconductor plate 110 to pass such that an electric field can be maintained along the channel axis under the voltage bias of source 42. It is the thermally generated electrons and holes which create the relatively low bias current that flows through the plate 110 from terminal 44 to terminal 34 of source 42 as shown in FIG. 1.

From an analysis of the microchannel electron source 26 hereinbefore described, based on conventional semiconductor theory and microchannel plate theory, the electron current gain G in the channel is determined from the gain equation:

$$G = exp(\Gamma X_1),$$

where the gain coefficient, $\Gamma$, is related to the secondary emission coefficient, $\delta$, and the collision length, $\iota_c$, of a channel electron along the channel axis as determined from:

$$\Gamma = +\frac{1}{X_1}\int_0^{X_1}\frac{1n\delta}{l_c}\,dx.$$

An integration is thus necessary to analyze the gain in a saturation mode since both $\delta$ and $\iota_c$ are functions of the electric field within the channel. For low level injection, the electric field is nearly constant and the gain equation reduces to that associated with standard prior art microchannel plate devices, from which the microchannel source geometry may be optimized.

In the embodiment hereinbefore described, wherein the junction formed by metalization layer 111 and impurity dopant layer 115 of FIG. 4 is ohmic to holes, the only electrons within the channel walls are the thermally generated ones. Being of a much smaller density than the holes created by secondary emission, they may be neglected in theory. For a semiconductor coating material 114 of GaAs, for example, the channel output current when plotted as a function of channel input current forms a curve 116 in FIG. 5 over a range that includes gain saturation. The dotted curve 118 is the thermally generated bias current flowing between terminals 34 and 44 of FIG. 1. This bias current in relation to the saturated output current is much lower than that for standard prior art microchannel plates which is in the order of ten times the saturated output current level.

Figure 6:
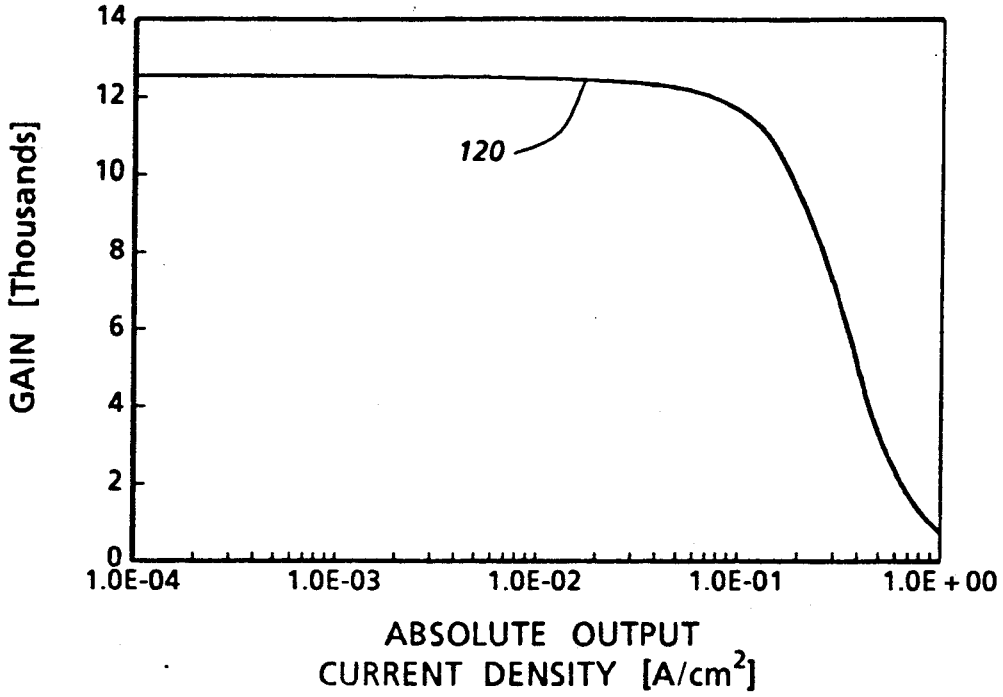

A gain curve 120 plotted as a function of output current in FIG. 6, shows gain saturation at an output current approaching 1 A/cm$^2$, which is approximately three orders of magnitude higher than that for standard prior art microchannel plates. The maximum saturated output current ($J_{out}$), as predicted from the semiconductor theory may be determined from:

$$J_{out} = -\frac{2\mu p(\epsilon_b + 1)\epsilon o E_a^2}{X_l}\left\{\frac{E_o}{E_a}\left[\frac{E_o}{E_a} - 1\right]\right\},$$

where $\epsilon_b$ is the dielectric constant and $\mu_p$ is the hole mobility of the semiconductor, $E_o$ is the electric field value at the channel input, and $E_a$ is the applied electric field value. The output channel current is a maximum when the magnitude of $E_o$ is large enough so that ion feedback and/or gain saturation occurs.

Figure 7:
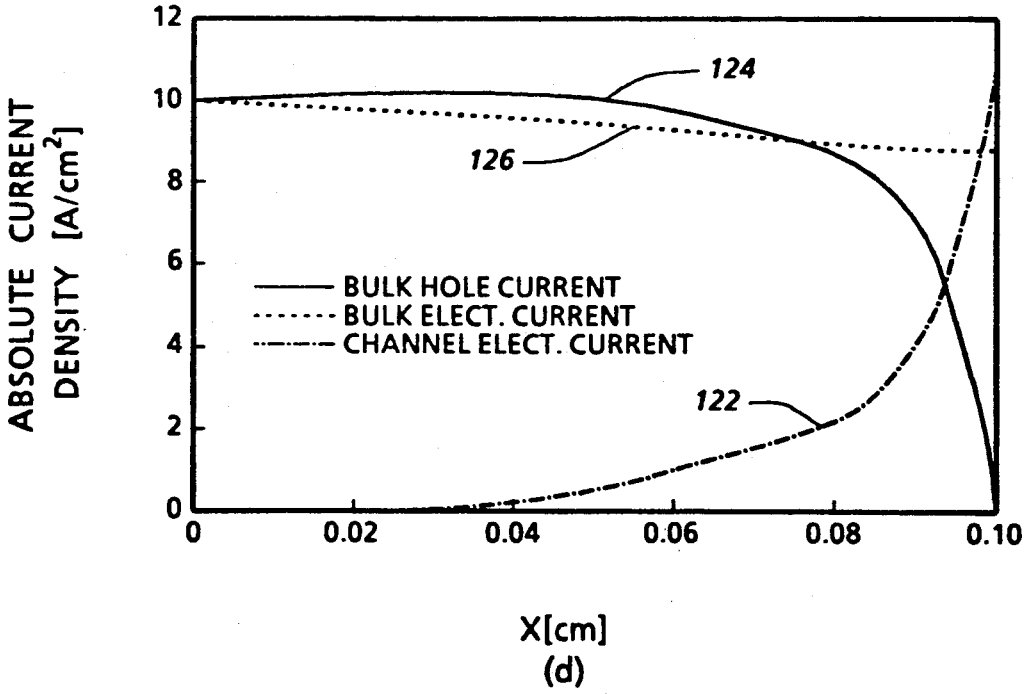

According to other embodiments of the invention, the metalization layer 111 with or without impurity dopant layer 115 in FIG. 4 form a barrier junction so that electron injection (under control by the hole density) from the metalization layer into the semiconductor substrate 110 neutralizes the holes in the channel walls produced by the secondary emission. This has the effect of extending the point at which the gain saturates to realize a much higher output current. Such barrier junction embodiment of the invention is reflected in FIG. 6 wherein the plotted channel current curve 122 is greater than 10 A/cm$^2$ at the channel output. The corresponding currents in the semiconductor for the holes and electrons are respectively plotted as curves 124 and 126 in FIG. 7. The finite bulk electron current, reflected by curve 126, has a value at the end of the channel such that the maximum efficiency is less than 100%. However, with judicious control of recombination traps in the semiconductor, this current can be reduced before the end of the channel is reached, involving usually a tradeoff with the maximum output current.

To those skilled in the art, many modifications and variations of the present invention are possible in light of the above teachings. It is therefore to be understood that the present invention can be practiced otherwise than as specifically described herein and still be within the spirit and scope of the appended claims.

What is claimed is:

1. In combination with a modulated signal source; electron emitter means operatively connected to said signal source for producing an electron emission and microchannel plate means in the electron emitter means for amplifying the electron emission, including a substrate made of semiconductor bulk having opposite faces and a plurality of electron passages extending between said faces and means for accelerating the electron emission through the passages including a material of lower conductivity completely coating the semiconductor bulk internally of said electron passages.

2. The combination of claim 1 wherein the accelerating means includes a source of bias voltage and contact means on the faces of the semiconductor substrate to which the source is connected for establishing an electric field through which the passages extend.

3. The combination of claim 2 wherein said contact means are ohmic junction layers on the faces of the semiconductor substrate.

4. The combination of claim 2 wherein said contact means are barrier junction layers on the faces of the semiconductor substrate.

5. In a microchannel electron source, a semiconductor substrate having opposite faces and a plurality of channel passages extending between said faces, a source of bias voltage and contact means coating said faces of the substrate and to which the bias voltage source is connected for establishing an electric field through which the passages extend, said contact means comprising junction layers of conductive material and impurity dopants deposited on the faces.

* * * * *